US005097780A

United States Patent [19]

Winchester

[11] Patent Number: 5,097,780

[45] Date of Patent: Mar. 24, 1992

[54] SUBSEA VEHICLE

[75] Inventor: Richard G.J. Winchester, Newton Hill, United Kingdom

[73] Assignee: Amerada Hess Limited, London, England

[21] Appl. No.: 435,403

[22] PCT Filed: Feb. 3, 1989

[86] PCT No.: PCT/GB89/00099

§ 371 Date: Oct. 31, 1989

§ 102(e) Date: Oct. 31, 1989

[87] PCT Pub. No.: WO89/07071

PCT Pub. Date: Aug. 10, 1989

[30] Foreign Application Priority Data

Feb. 3, 1988 [GB] United Kingdom ..... 8802369

[51] Int. Cl.[5] ..... B63G 8/00

[52] U.S. Cl. ..... 114/330

[58] Field of Search ..... 114/312-313, 114/330-333, 337, 338; 405/191

[56] References Cited

U.S. PATENT DOCUMENTS 826,868 7/1906 Neves ..... 114/330

3,521,589 7/1970 Kemp ..... 114/330

FOREIGN PATENT DOCUMENTS 63492 3/1989 Japan ..... 114/330

*Primary Examiner*—Jesûs D. Sotelo

*Attorney, Agent, or Firm*—Nixon & Vanderhye

[57] ABSTRACT

A subsea inspection vehicle which is intended to be remotely operated comprises a substantially cylindrical pressure vessel (1). A pair of generally arcuate buoyancy tanks (8) and external equipment (3,7) are supported on the vessel (1) in a manner arranged such that the vessel remains substantially astable. A plurality of thrusters (16,18) are carried by the vessel (1) and are arranged to enable movement of the vessel (1) relative to all six degrees of freedom provided by its astable configuration. The vessel can be moved in any direction at any attitude of pitch, roll or yaw and can thereby emulate the flexibility of movement of a diver.

58 Claims, 6 Drawing Sheets

Figure 1:
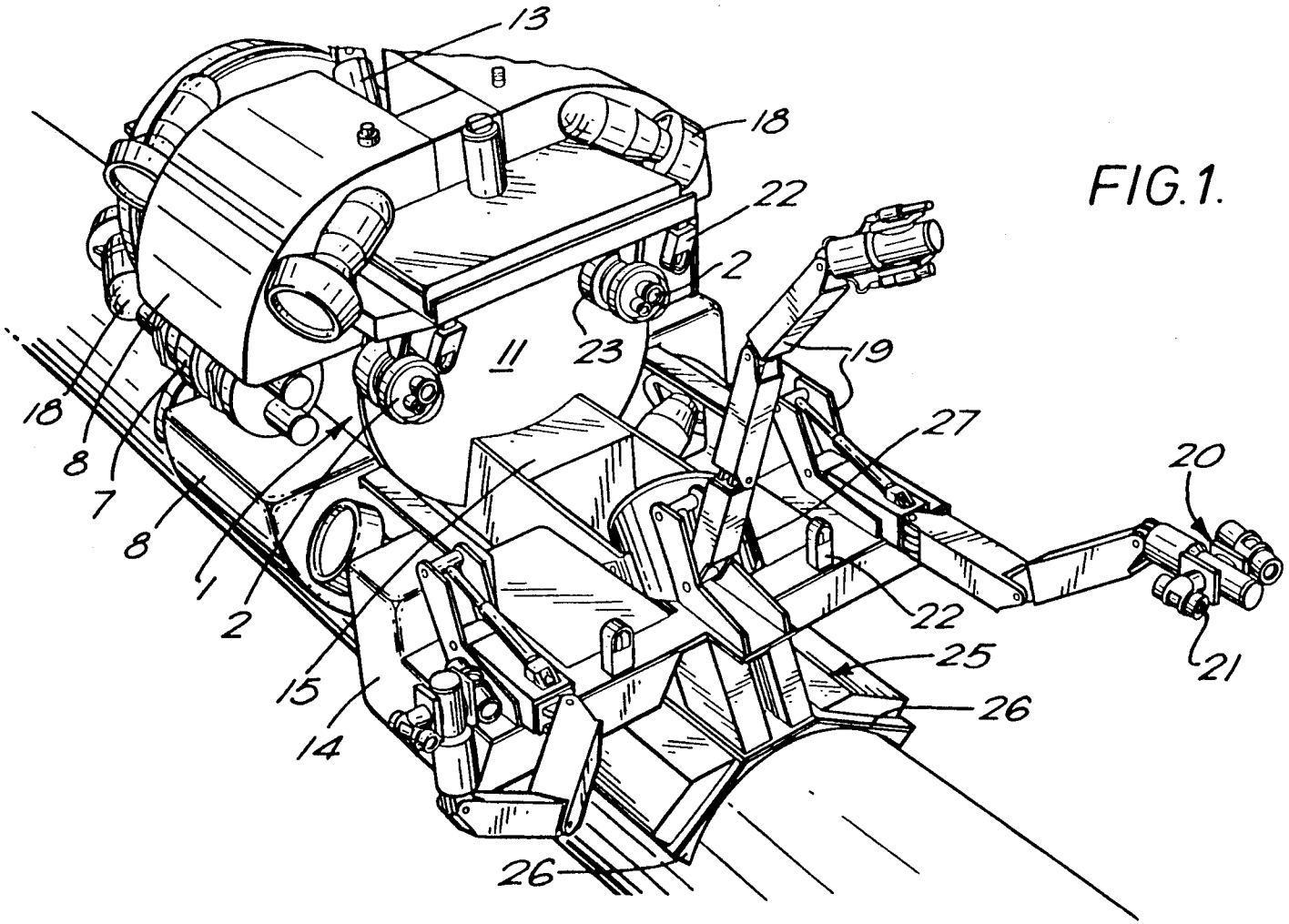

-D-
-C-
30
N
19
25
30
30
B
-A-
-B-
8
B
1

SUBSEA VEHICLE

The present invention relates to a subsea vehicle and to a method of working on an underwater work site using such a vehicle.

Presently, a number of routine underwater tasks are performed by remotely operated vehicles. However, such vehicles cannot emulate the flexibility of movement of a diver and accordingly, more advanced and sophisticated tasks underwater still have to be undertaken by divers.

It is an object of the present invention to provide a subsea vehicle having more flexibility of movement than known vehicles.

According to a first aspect of the present invention there is provided a subsea vehicle comprising a pressure vessel, and drive means supported by said pressure vessel for causing movement thereof, wherein said pressure vessel is arranged to be substantially astable, and said drive means are arranged to enable movement of said pressure vessel relative to six degrees of freedom.

Thus, the pressure vessel is displaceable in translational directions whose components can be defined in three orthogonal dimensions. Furthermore, the pressure vessel is also movable in angular directions whose components can be defined by a set of spherical co-ordinates.

The six degrees of freedom capability of the pressure vessel enables the pressure vessel to be moved in any direction at any attitude of pitch, roll or yaw.

Because the vehicle is able to achieve a full six degrees of freedom of movement it is able to emulate a diver and therefore is more flexible than prior art vehicles.

In an embodiment the astable pressure vessel is arranged to be able to roll through $\pm 180°$ and to pitch through $\pm 90°$. Preferably, the vessel has the ability to roll through 360 degrees.

Preferably, the pressure vessel is substantially cylindrical. Electrical and electronic systems of the vehicle can be mounted within the pressure vessel.

Preferably, the drive means comprise a plurality of individual thrusters supported by the pressure vessel and arranged to provide movement thereof in the six degrees of freedom.

Whilst it would be possible to mount the thrusters to be pivotable or otherwise displaceable to different orientations, it is preferred that the thrusters should all be fixed in their alignment such that it is reliably ensured that movement relative to all of the six degrees of freedom is provided for.

In a preferred embodiment at least six thrusters are supported on the pressure vessel. Two of these thrusters are mounted on an end surface of the pressure vessel on a transverse axis of the pressure vessel. Preferably, these two end thrusters are equidistantly spaced on either side of the central longitudinal axis of the vessel at the aft end. Preferably, each end thruster is inclined at an angle to said transverse axis, for example, of substantially 30 degrees.

The other four thrusters, are mounted circumferentially of the pressure vessel. Preferably, these thrusters are equidistantly spaced around the circumference of the pressure vessel at a single longitudinal location of the vessel. In this embodiment, each of the circumferentially mounted thrusters is located on a radius of the vessel extending substantially at 45 degrees to the transverse axis thereof. Alternate ones of these thrusters face in opposite directions.

In a preferred embodiment two groups of four circumferentially arranged thrusters are provided, each group being located at opposite ends of the cylindrical pressure vessel. Thus, at least ten thrusters in all are provided.

Generally, the two aft thrusters provide longitudinal thrust forward and aft and give the pressure vessel a degree of yaw capability. The circumferentially mounted thrusters can be used in different combinations for rolling and pitching the pressure vessel and to translate the pressure vessel both transversely and along a third axis, which is generally vertical, which is orthogonal to both the longitudinal and transverse axes of the pressure vessel.

Preferably, the pressure vessel supports one or more manipulators. Where thrusters are supported at the aft end of the pressure vessel, it is particularly suitable for the or each manipulator to be supported at the forward end of the pressure vessel.

The number, type, and method of control of the manipulators may be chosen as required. However, it is particularly useful if at least two manipulators are provided which are moveable, at least in some dimensions, relative to one another.

Generally, the pressure vessel supports buoyancy tanks arranged to give the vehicle the required buoyancy and the required centre of buoyancy. The position and volume of these tanks is chosen in dependence upon the weight and position of the equipment to be supported on said pressure vessel. Preferably, a pair of generally arcuate buoyancy tanks are arranged around the circumference of the pressure vessel substantially opposite to one another. In addition, the manipulators and other equipment may be supported on the pressure vessel by appropriate buoyancy tanks forming support frames therefor.

The ancillary equipment carried by the pressure vessel may comprise two spaced video cameras which are mounted on a fixed and known baseline. For example, the two video cameras may be mounted on the transverse axis of the pressure vessel at the forward end thereof. A controller, for example, incorporating a microprocessor, can be provided for driving pan and tilt units for these video cameras, with their position and their movement being described by an appropriate set of co-ordinates. It is also proposed to describe the manipulator positions and movement by way of the same co-ordinate system and to couple a control system for the manipulators to the camera controller This makes it possible to drive the video cameras to follow the manipulators as they travel. Furthermore, by focusing both of the cameras on a single point, the location of this point can be accurately described and thus the movement of part of one or more manipulators accurately to that point can be simply achieved. Preferably, the position and movement of the cameras and manipulators is defined by a set of orthogonal co-ordinates.

The present invention also extends to a control system for at least one manipulator comprising manipulator control means for controlling movement of the manipulator and for receiving information as to the position of the manipulator, at least two sight means positioned on a common baseline, means for adjusting the orientation of the sight means, and control means for controlling said adjusting means and for receiving information as to the orientation of the sight means, wherein said manipulator control means and said control means for the sight means are arranged to communicate.

Preferably, said manipulator control means and the control means for the sight means are coupled such that information as to the position of the manipulators can be fed to the control means for the sight means, and conversely, so that information as to the orientation of the sight means is receivable by said manipulator control means.

Preferably, and as described above, the position information in respect of the manipulators and the orientation information in respect of the sight means is described using the same system of orthogonal co-ordinates As described above, said sight means are preferably video cameras.

According to a further aspect of the present invention there is provided a method of working on an underwater work site using a remotely operated subsea vehicle, comprising orientating the vehicle near the work site in an upright attitude relative to the work site with a forward end of the vehicle facing the work site and then performing tasks at the work site by way of equipment carried at the forward end of the vehicle.

Preferably, the vehicle is movable relative to six degrees of freedom so that it can be orientated in an upright attitude relative to the work site irrespective of the orientation of the work site.

Preferably, the vehicle is provided with attachment means for attaching the vehicle in its upright attitude to a support surface. The attachment means may enable the vehicle to be translated and/or rolled relative to said support surface.

According to a still further aspect of the present invention there is provided a subsea vehicle having drive means arranged to enable movement of said vehicle in angular directions whose components can be defined by a set of spherical co-ordinates, and processor means for controlling the drive means, wherein, said vehicle is also provided with sensing means for determining the angular attitude of the vehicle, said processor means being responsive to said sensing means.

In an embodiment, said sensing means supplies data to the processor means representative of the roll angle and the pitch angle of the vehicle. The processor means may also be provided with data representative of the rate of change of the yaw angle of the vehicle.

In a preferred embodiment, a depth sensor is mounted on said vehicle and is arranged to supply information to said processor means. The depth sensor is preferably a pressure transducer mounted close to the roll centre of the vehicle.

Said processor means is also arranged to be responsive to demands made by an operator.

Figure 2:
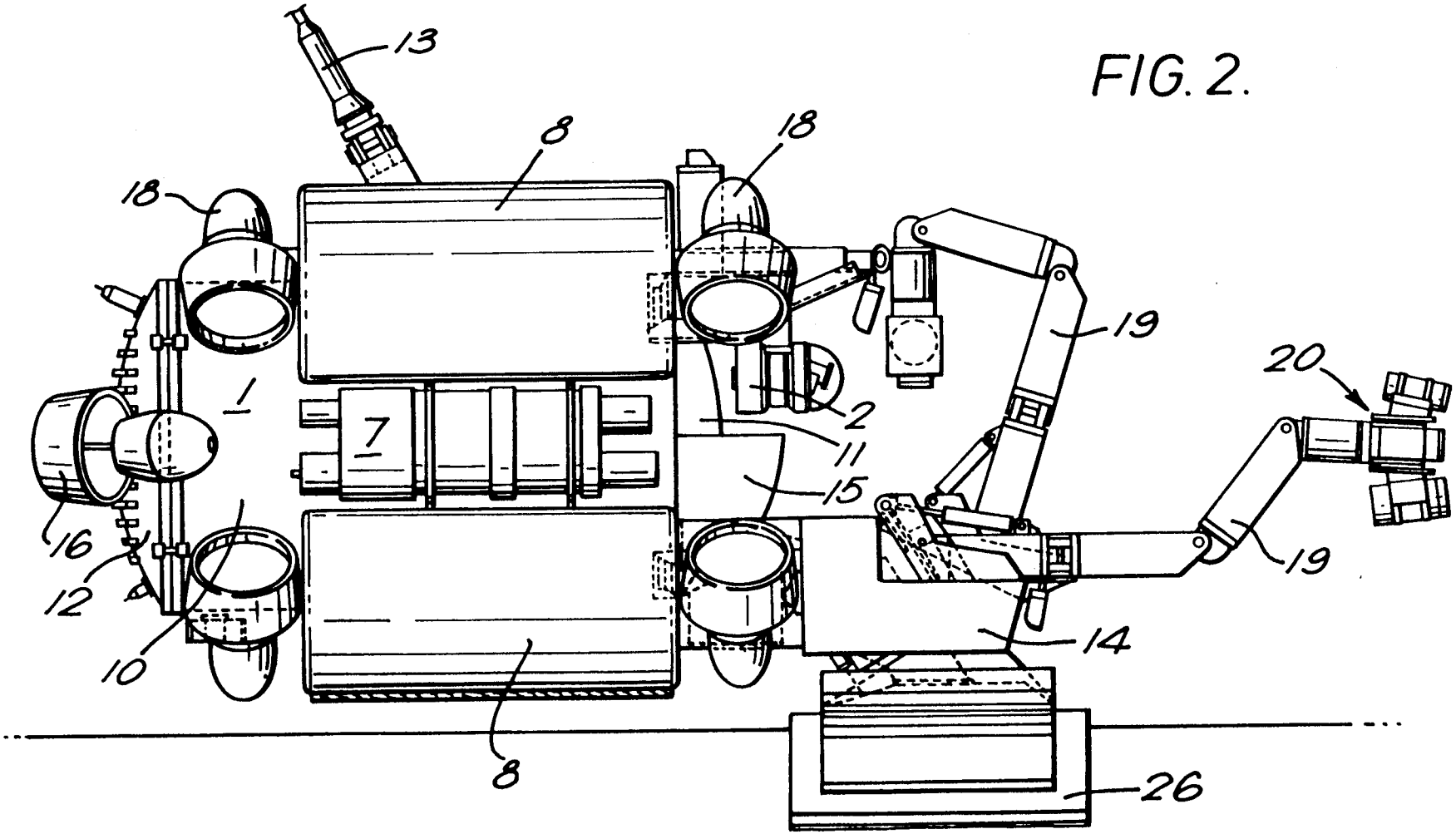
Figure 3:
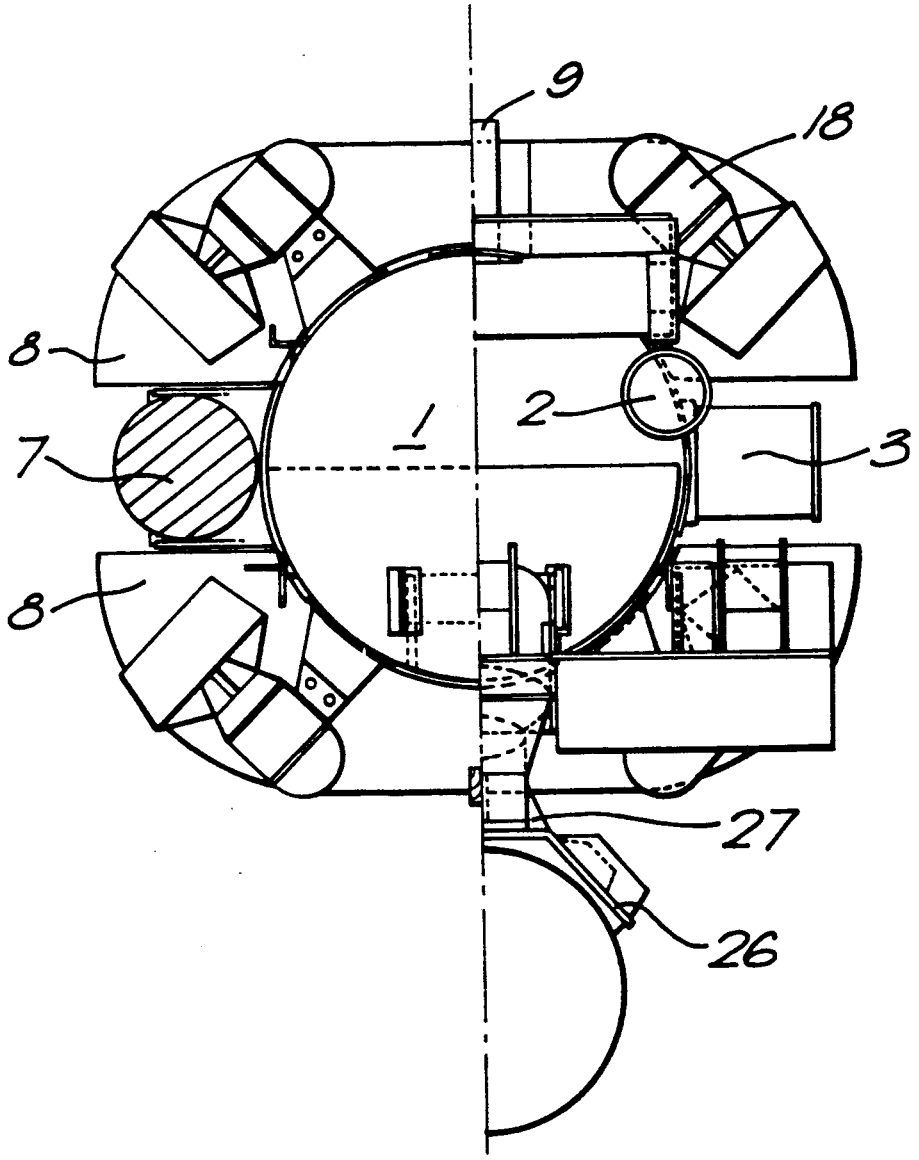
Figure 4A:
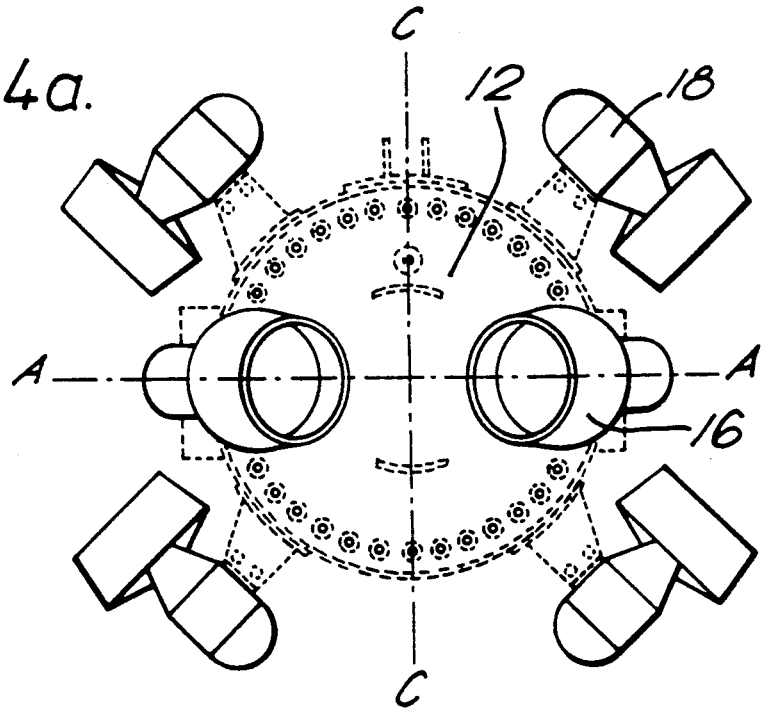
Figure 4B:
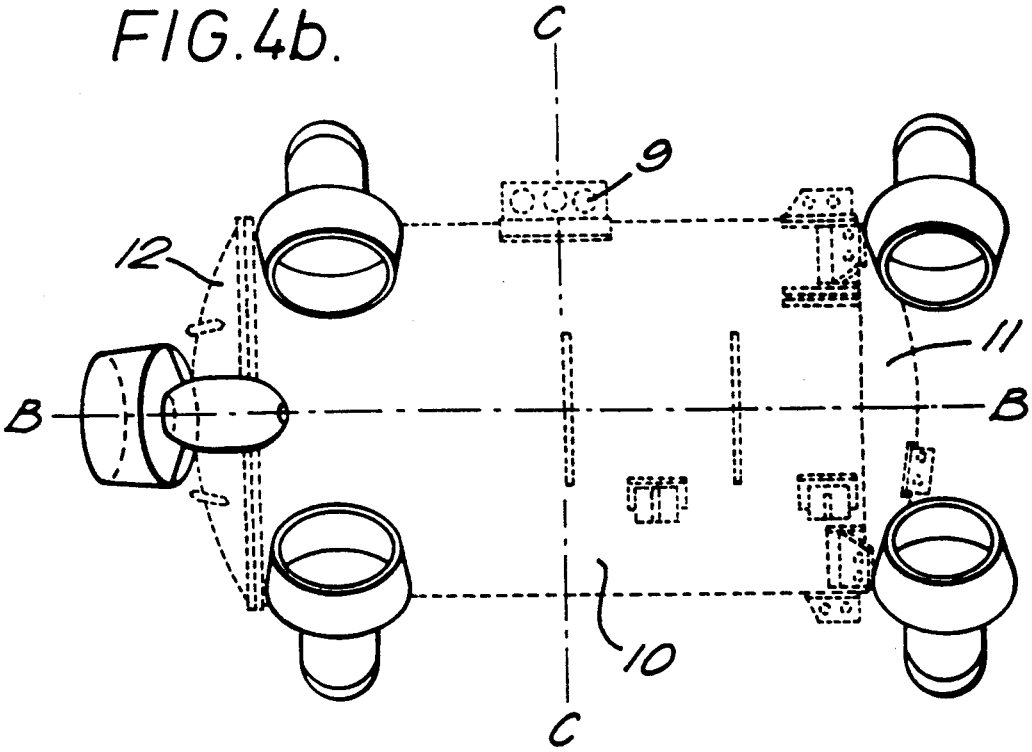
Figure 5:
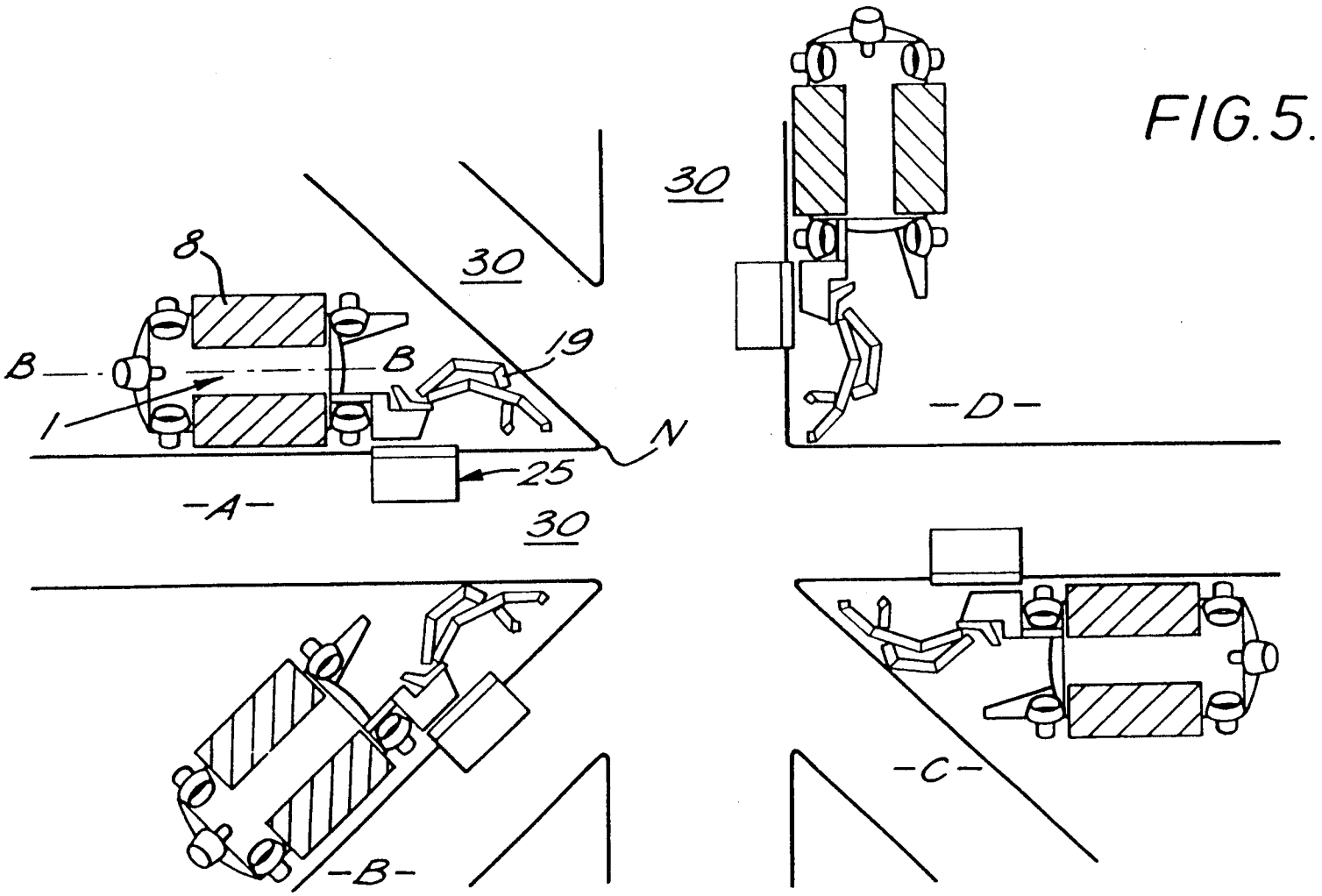
Figure 6:
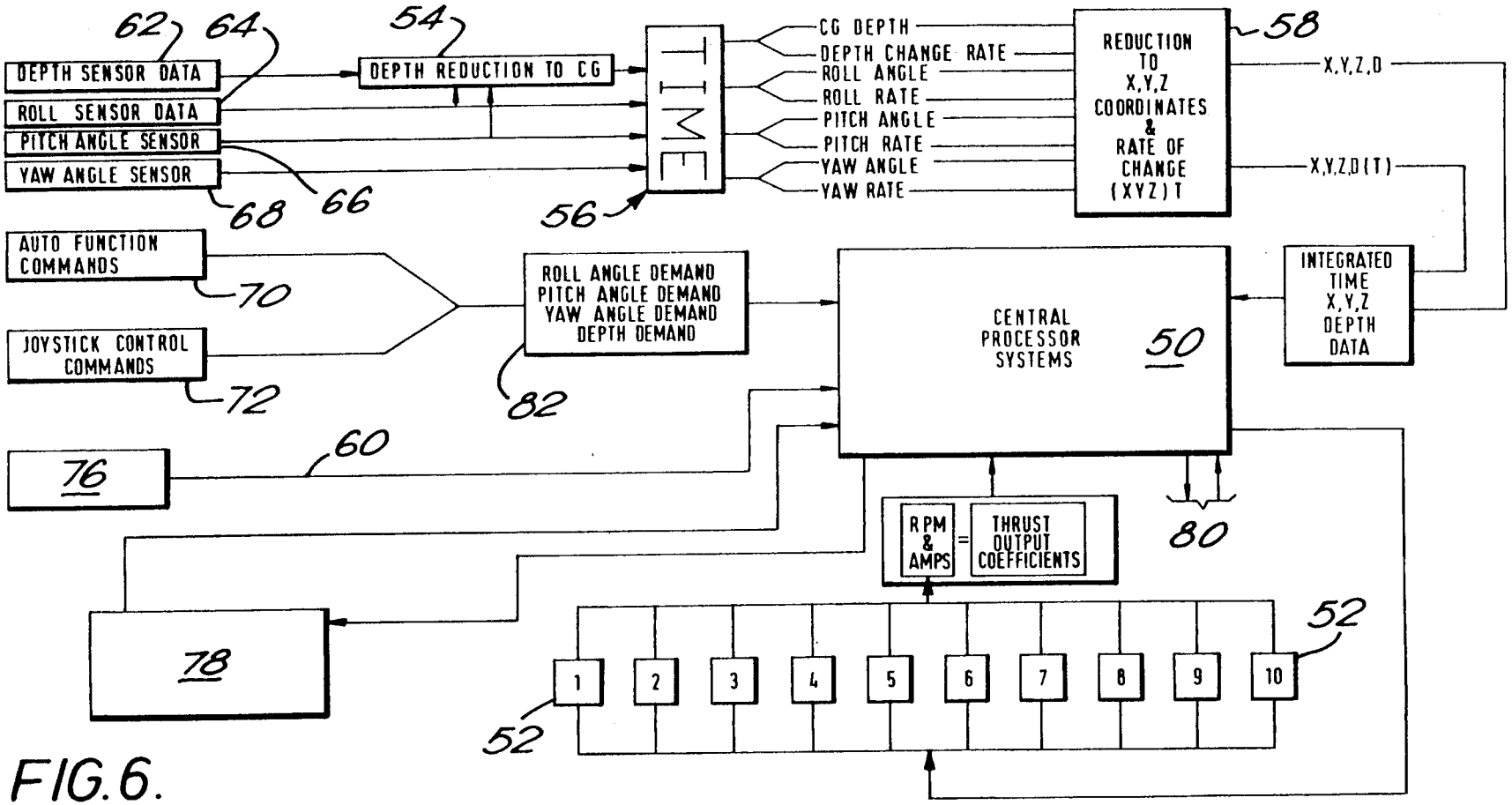

Preferably, and as defined above, said drive means comprise a plurality of individual thrusters controlled by said processor means. Furthermore, and again as defined above, the vehicle is preferably comprised of a substantially astable pressure vessel on which the drive means are supported to enable movement of said pressure vessel relative to six degrees of freedom. Embodiments of the present invention will hereinafter be described, by way of example, with reference to the accompanying drawings, in which:

FIG. 1 shows schematically a perspective view of a remotely operated subsea vehicle, FIG. 2 shows a side view of the vehicle of FIG. 1, FIG. 3 shows a front end view of the vehicle of FIGS. 1 and 2 with the manipulators removed, and partially with other equipment removed, FIGS. 4*a* and 4*b* show respectively an aft end view and a side view of the vehicle of FIG. 1, the vehicle being indicated in outline only to illustrate the positioning of thrusters, FIG. 5 shows an underwater structure and schematically indicates different orientations taken up by said vehicle for access to different work sites, and FIG. 6 shows schematically a control system for a subsea vehicle. FIG. 1 shows schematically a perspective view of a subsea inspection vehicle which is intended to be remotely operated. This vehicle is specifically designed for use underwater to clean and inspect subsea structures. A side view of the vehicle is shown in FIG. 2, whilst FIG. 3 shows a view of the front of the vehicle with its manipulators removed, and partially with other equipment removed, for clarity.

It will be seen from FIGS. 1 to 3 that the vehicle comprises a substantially cylindrical pressure vessel 1, for example, formed of aluminium. This pressure vessel 1 has a tubular body 10 to which a forward domed end cap 11 is permanently fixed, and having a detachable domed stern end cap 12. Substantially centrally of the longitudinal extent of the tubular 10, the pressure vessel 1 is provided with a main lift point 9 to which an umbilical tether 13, for supplying services, is arranged to be connected. Other fittings may be provided externally of the pressure vessel 1 to carry ancillary components, such as an hydraulic pack 7, a pair of video cameras 2, and a valve pack 3. Additional equipment (not shown) for the vehicle is mounted within the pressure vessel 1. For example, this equipment may include a transformer unit and a rack-mounted electrical system for the vehicle. These internal components are not illustrated in the drawings for clarity.

A pair of buoyancy tanks 8 are mounted on the pressure vessel 1 externally thereof. In the embodiment illustrated, these buoyancy tanks 8 are each generally arcuate in shape and are arranged opposed to one another such that they substantially surround the tubular body 10 except for two longitudinally extending spaces in which the valve pack 3 and the hydraulic pack 7 are received. Thus, the periphery of the vehicle carrying the buoyancy tanks 8 and the packs 3 and 7 remains substantially cylindrical.

Because the pressure vessel is cylindrical it is generally astable, and it will be appreciated that the external equipment, as 3, 7, and the buoyancy tanks 8 are supported thereon in a manner arranged to maintain the astable characteristics required.

The pressure vessel 1 carries drive means in the form of a plurality of thrusters 16 and 18 which are arranged to enable movement of the vessel relative to all six degrees of freedom provided by the astable configuration. In the embodiment illustrated, ten thrusters 16, 18 in all are supported on the pressure vessel, and are arranged as two aft thrusters 16 and two groups of four circumferentially mounted thrusters 18.

The relative orientation of the thrusters 16, 18 can most clearly be seen in FIGS. 4*a* and 4*b* which respectively indicate a stern elevation and a side elevation of the vehicle, the vessel 1 being outlined in dotted lines whilst the outlines of the thrusters 16, 18 are shown in full lines. It will be apparent from FIG. 4*a* that the two aft thrusters 16 are mounted at either side on the aft end of the tubular body 10 on a transverse axis A—A thereof. These two thrusters 16 extend and converge in the longitudinal direction of the vessel 1 and each is at an angle of 30 degrees relative to the transverse axis A—A. These two thrusters 16 can be controlled to move the vessel forward and aft, that is, substantially in the direction of its longitudinal axis B—B. In addition, the two thrusters 16 can be controlled to give yaw capability to the vessel, that is, to provide movement in the transverse plane relative to the longitudinal axis B—B.

The thrusters 18 are arranged in two groups of four, circumferentially mounted about the fore and aft ends of the tubular body 10 of the vessel 1. The four circumferentially mounted thrusters 18 at each longitudinal location are equidistantly spaced around the circumference. It will be appreciated that each thruster 18 extends substantially parallel to a tangent to the cylindrical pressure body 10 and is located on a radius thereof extending at 45 degrees to the transverse axis A—A and hence to the third orthogonal axis C—C of the vessel 1. It will also be appreciated that alternate ones of the thrusters at each longitudinal location face in opposite directions. The arrangement of the eight thrusters 18 is such as to enable different combinations of the thrusters to be used to cause rolling of the pressure vessel around its longitudinal axis B—B, and pitching of the vessel about the third axis C—C, which is shown to extend vertically. In addition, the thrusters 18 can be used to translate the vessel along the third axis C—C and also transversely along the transverse axis A—A. Of course, combinations of all of these movements can be achieved.

The number, positioning and relative orientation of the thrusters 16, 18 can be chosen as required to suit the characteristics of any particular vehicle. Similarly, the thrusters or other alternative drive means may be of any required design suitable for use underwater.

In a preferred embodiment, the thrusters 16 and 18 incorporate brushless DC motors because such motors are particularly energy efficient, are reliable, and have the added advantage of being able to produce more power from a small package.

A number of manipulator arms 19 are carried at the forward end of the pressure vessel 1. In the embodiment illustrated, three manipulator arms 19 are provided, the central arm being supported by the forward end cap 11 of the pressure vessel 1 by way of a support frame 15 and the two, outer manipulator arms being supported on the end cap 11 by way of respective support frames 14. Again, the number, method of support, type of manipulator and control means therefor may be chosen as required.

Preferably, and as illustrated, the support frames 14 and 15 are constructed as buoyancy tanks which can be trimmed to provide the vessel 1 with a suitable centre of buoyancy depending upon the weight and positioning of the manipulator arms 19 and of any other equipment supported on the pressure vessel 1.

The three manipulators 19 illustrated in the drawings are substantially conventional multi-segment arms, each segment being pivotally connected to the next, with at least two of the pivot axes of each arm extending substantially orthogonally to provide maximum freedom of movement for that arm. In addition, at its free end, each manipulator 19 is equipped with a tool or tool table 20 which is rotatable through 270 degrees.

In the embodiment illustrated, the manipulator arms 19 are moved as required by hydraulic power supplied from the hydraulic pack 7 and controlled by solenoid valves (not shown) of the valve pack 3.

Movement of the manipulator arms 19 is under the control of a manipulator control system (not shown) provided at the surface and connected to the valve pack 3 by way of the umbilical tether 13. It will be appreciated that any suitable control system for the manipulators 19 may be provided, but preferably, the control system incorporates a microprocessor. In one preferred embodiment, the control system incorporates master arms, each corresponding to a respective individual manipulator, which allows the operator on the surface a degree of "feel" in operating the manipulator arms.

Preferably, the manipulator arms are controlled using a Cartesian or other orthogonal co-ordinate system. Thus, the x, y and z co-ordinates of each tool carried by a manipulator can be calculated by measuring each joint angle, for example by way of potentiometers at the joint of each manipulator, and by storing accurate information as to the geometry of each manipulator arm. In this way, if a tool of a manipulator is working on a defect, the exact position of the manipulator tool can be calculated whereby the position of that defect can be determined.

To maintain accuracy, each manipulator will have at least one reference position on the vehicle to which it can be returned as required such that the control system for the manipulators can be re-calibrated. These reference positions are generally the rest positions of the manipulators.

The use of an orthogonal co-ordinate system for the manipulator control system enables the operator to perform tasks very accurately. For example, before undertaking a cleaning or inspection operation, the operator can cause the tool of each manipulator to premeasure its route by touching a number of points along the route it will need to take. These points will each be described in orthogonal co-ordinates and interpreted by way of the processor of the manipulator control system to create a single curve along which the manipulator arm will then be controlled to move. If necessary, vertical or horizontal offsets can be pre-set to avoid damage to instruments, for example, carried by the manipulators, and limits can be pre-set to prevent the operator from exceeding those offsets. For example, when cleaning a structure using high pressure water from cavitation jets, this system can prevent loss of cleaning effectiveness caused by positioning the jet either too close or too far away from the surface being cleaned.

Data as to the position of the manipulators and their tools is continually fed back to the surface enabling the position and extent of the defects and other items of interest on the structure being inspected to be determined. This manipulator positional data is integrated with vehicle positional data, giving the roll, pitch and heading of the vehicle as will be described hereinafter, so that the absolute position of any point touched by the tool of one of the manipulators can be calculated with a high degree of accuracy.

It will be appreciated that the operator on the surface needs to "see" the structure being inspected or worked upon. In this respect, one or more of the manipulators 19 may carry a video camera as 21. Light sources, as 22, are provided on the forward end of the vehicle and may also be carried by the manipulators if necessary.

As made clear previously, the forward end of the pressure vessel 1 additionally carries a spaced pair of video cameras 2, which are preferably mounted at either side of the cylindrical body of the pressure vessel on the transverse axis thereof, which defines a fixed, common baseline. Each of these video cameras 2 is mounted by way of a pan and tilt unit, indicated at 23, for enabling the orientation of the camera to be selectively adjusted. Again, a control system (not shown) for the pan and tilt units 23 incorporating processor means is provided, preferably on the surface. The processor means of the pan and tilt unit control system uses the same co-ordinate system as used by the manipulator control system, and the two control systems are arranged to communicate. The pan and tilt units for the cameras 2 are provided with position feedback potentiometers (not shown) to give to the control system information as to the orientation of the video cameras 2.

Because the control systems for the cameras 2 and for the manipulators 19 communicate, it is possible for the software of the manipulator control system to determine the position of a manipulator tool and then for the control system for the cameras to cause movement of the cameras 2, by way of their pan and tilt units 23, to a correct position to view the manipulator tool.

The communicating control systems for the pair of cameras 2 and the manipulators 19 also make it possible to determine the position of a point or object by use of the video cameras. Each camera is provided with bore sights, for example cross-hairs on the lens or an electronically produced crosswire, and the operator then drives the cameras to line up on the target, that is to both be aligned on the same point. By calculating the x and y angles of each camera relative to the vehicle and by comparing these angles for the two cameras 2 on the common baseline, the software of the control system for the cameras is able to calculate the position of the target. If this information is then fed to the manipulator control system, one of the manipulators can be driven to the appropriate position.

The vehicle illustrated in FIGS. 1 to 4 is additionally provided with an attachment system, generally referenced 25. Generally, this attachment system comprises two plates 26 each pivotably mounted on a tubular member (not shown) slidably received within a body member 27. Means (not shown) are provided to advance the tubular member, and hence the plates 26, longitudinally relative to the body member 27. Conveniently, the advancing means comprises a thruster (not shown) housed within the body member 27. In addition, hydraulic rams (not shown) are provided to position each plate 26 at a predetermined angle relative to the body member 27 and to maintain the plates in position. It will be appreciated that each plate 26 can thereby be clamped into position on a structural member, such as the tubular structural member 30 illustrated.

When the plates 26 of the attachment device 25 are so clamped onto the structural member 30, movement of the vehicle away from the structural member 30 is prevented. However, contact between each plate 26 and the support member 30 is preferably by way of one or more castors (not illustrated) mounted on the contact surface of the plate 25. By this means, movement of the vehicle along the structural member and/or around the member 30 is enabled.

The manner in which the vehicle would normally be used at a work site is schematically illustrated in FIG. 5. In this respect, FIG. 5 shows an underwater structure made from a number of interconnected tubular members 30. Commonly it is required to clean and inspect the welds of such a structure, the welds occurring at each area where two of the tubular members are joined.

In the position marked A in FIG. 5, the vehicle is arranged in its upright position in which the pressure vessel 1 exhibits zero degrees of roll about its longitudinal axis B—B and zero degrees of pitch. The tubular member 30 to which the vehicle is attached, by way of the attachment system 25, extends substantially horizontally. It will be seen that in position A of the vehicle, the node N to be cleaned and inspected is substantially directly in front of the vehicle.

In position B, whilst the vessel 1 still has a zero degree roll angle, it has been moved through a pitch angle of 45 degrees. Again, in this position it will be seen that the work site is again directly in front of the vehicle.

In position C, the pitch angle of the vessel is zero degrees, but it has been rolled through 180 degrees. In position D, the pitch angle is −90 degrees and the roll angle is zero.

It will be appreciated that in each of the positions A, B, C and D, illustrated in FIG. 5 the work site is directly in front of the vehicle. Furthermore, the whole length of the support member 30 to which the vehicle is attached can be inspected simply by translating the vehicle therealong whilst still attached. This enables effective and efficient use to be made of relatively simple manipulator arrangements with consequent reliability. Furthermore, regardless of the angle at which the support member extends, the vehicle once affixed thereto can roll around the tubular member.

As is described above, the vehicle is driven by the thrusters 16, 18 which are controlled by a central processor unit, as 50, FIG. 6. This processor unit 50 is arranged to determine how much thrust each of the thrusters should apply to achieve the attitude required. In this respect, and as shown in FIG. 6 the following information is utilised by the processor 50 to enable it to determine the power distribution to the thrusters:

1. Roll angle.
2. Pitch angle.
3. Rate of change of yaw angle.
4. Depth.
5. Operator Demand.

In addition, information as to the current centre of buoyancy and centre of gravity of the vehicle is fed to the processor 50 by way of a line 60 on manual initialisation. This initialisation process is performed manually in order to allow for any changes in pay load of the vehicle. It will be seen that the line 60 is connected to a control panel 76 for enabling other operator demands or information to be input to the processor 50.

The depth information is obtained by way of a depth sensor, schematically represented at 62, which is preferably a pressure transducer, mounted on the vehicle forwardly thereof as near to the longitudinal axis B—B of the pressure vessel 1 as possible. The output of the depth sensor 62 is first fed to register means 54, which also receives data from roll sensor means 64 and pitch angle sensor means 66. The data as to the vehicle's roll angle and pitch angle received by the register means 54 is, of course, representative of the attitude of the vehicle. A computation is performed in the register means 54, by way of an appropriate software sub-routine, to adjust the depth information in accordance with the attitude data. By this means, the depth data is representative of the depth beneath the vehicle irrespective of its attitude.

The roll sensor means 64 and pitch angle sensor means 66 are incorporated in a vertical reference unit (not illustrated) which is fitted within the pressure vessel 1 at or about the centre of buoyancy of the vehicle. This is generally at a position slightly forward of the centre point of the pressure vessel 1. For example, the sensor means 64 and 66 may be constituted by the gyroscope of a standard vertical reference unit arranged to provide signals representative of the pitch angle and roll angle of the vessel. In addition, a yaw rate gyro, represented at 68, is arranged to supply information as to the rate of change of the yaw angle. The yaw rate gyro 68 is also housed within the vessel 1.

The adjusted depth data output from the register means 54, and the data as to roll angle, pitch angle, and yaw angle of the vehicle, is fed to an integrator 56 where the rates of change of the sensed data are computed. The data and the rate of change data is then presented by way of a convertor 58, which converts the data into orthogonal co-ordinates, to the central processor 50.

FIG. 6 also indicates that attitude and position demands made for the vehicle, either automatically by way of an auto controller 70, or by way of an operator, using a joystick operated control means 72, are fed to the processor 50. These demands are presented to the processor 50 by way of a convertor 58 which converts the data into orthogonal co-ordinates It will be appreciated that the processor 50 compares the demands made, either automatically or by way of the operator, with the data obtained from the sensors and determines therefrom the demands to make on the thrusters 16, 18 of the vehicle. A pre-programmed database of thruster geometry and the power sharing of the thrusters provides information to enable the processor 50 to determine which thrusters to activate and how much thrust from each thruster is required. The processor 50 then sends appropriate control signals to thruster control units 52. As will be seen in FIG. 6, a single thruster control unit 52, is associated with each thruster, and the thruster control units 52 are arranged to supply to the central processor 50 data as to the power supply and speed of rotation of their associated thrusters.

In the embodiment illustrated, the central processor 50 is also arranged to constitute the control means for the video cameras 2. In this respect, the processor 50 is arranged to send appropriate control signals to a control unit 78 for the pan and tilt units 23 of the cameras 2. Information from the pan and tilt units as to the orientation of the cameras 2 is also fed to the processor 50.

It will be appreciated that other inputs to and outputs from the processor 50 may be made if required. For example, the processor 50 may constitute the control means for the manipulators 19 and may be arranged to provide control signals to drive units therefor and to receive information therefrom. This is illustrated in FIG. 6 by the further interfaces 80.

It will be appreciated that variations in and modifications to the vehicle as described above may be made within the scope of the present invention.

I claim:

1. A subsea vehicle comprising a vehicle structure having a pressure vessel, and drive means supported by said vehicle structure for providing propulsion thereto, wherein said vehicle structure is configured to be substantially astable, and wherein said drive means are positioned on the vehicle structure such that they are able to displace said vehicle structure in translational directions whose components can be defined in three orthogonal dimensions, and to move the vehicle structure in angular directions whose components can be defined by a set of spherical coordinates, and wherein the drive means comprise a plurality of individual thrusters supported by the vehicle structure and arranged to provide movement thereof in the six degrees of freedom, the thrusters all being mounted in a fixed, predetermined alignment.

2. A subsea vehicle as claimed in claim 1, wherein said astable vehicle structure is arranged to be able to roll through ±90°.

3. A subsea vehicle as claimed in claim 2, wherein the vehicle structure has the ability to roll through 360 degrees.

4. A subsea vehicle as claimed in claim 1, wherein at least six thrusters are supported on the vehicle structure.

5. A subsea vehicle as claimed in claim 4, wherein two thrusters are mounted on an end surface of the vehicle structure on a transverse axis of the vehicle structure.

6. A subsea vehicle as claimed in claim 5, wherein said two end thrusters are equidistantly spaced on either side of the central longitudinal axis of the vehicle structure at the aft end.

7. A subsea vehicle as claimed in claim 6, wherein each said end thruster is inclined at an angle to said transverse axis.

8. A subsea vehicle as claimed in claim 7, wherein said two end thrusters are each inclined at an angle of substantially 30 degrees to said transverse axis.

9. A subsea vehicle as claimed in claim 5, wherein four thrusters are mounted circumferentially of the vehicle structure, said circumferentially mounted thrusters being equidistantly spaced around the circumference of the vehicle structure at a single longitudinal location of the structure.

10. A subsea vehicle as claimed in claim 9, wherein each of the circumferentially mounted thrusters is located on a radius of the vehicle structure extending substantially at 45 degrees to the transverse axis thereof.

11. A subsea vehicle as claimed in claim 9, wherein alternative ones of said circumferentially mounted thrusters face in opposite directions.

12. A subsea vehicle as claimed in claim 1, including at least ten thrusters supported on the vehicle structure, a pair of said thrusters mounted adjacent one end of the vehicle structure and on a transverse axis thereof, a first group of four of said ten thrusters, excluding said pair of said thrusters, mounted circumferentially of the vehicle structure and substantially equidistantly spaced about the circumference of the vehicle structure, and a second group of four of said ten thrusters, excluding said pair of said thrusters and said first group of said four of said ten thrusters, mounted and spaced circumferentially about the vehicle structure, said first and second groups of thrusters being mounted adjacent respective opposite ends of the vehicle structure.

13. A subsea vehicle as claimed in claim 1, wherein a manipulator is supported on said vehicle structure.

14. A subsea vehicle as claimed in claim 1, wherein selected ones of said individual thrusters are supported at the aft end of the vehicle structure, and wherein a plurality of manipulators are supported at the forward end of the vehicle structure.

15. A subsea vehicle as claimed in claim 1, wherein at least two manipulators are supported on said vehicle structure, said manipulators being moveable relative to one another.

16. A subsea vehicle as claimed in claim 1, wherein the vehicle structure includes a pressure vessel and further comprises buoyancy tanks supported by said pressure vessel and arranged to give the vehicle structure the required buoyancy and the required center of buoyancy.

17. A subsea vehicle as claimed in claim 1, wherein a pair of buoyancy tanks are arranged around the perimeter of the vehicle structure substantially opposite to one another.

18. A subsea vehicle as claimed in claim 1, wherein said vehicle structure includes a pressure vessel which is substantially cylindrical, and wherein a pair of buoyancy tanks are supported by said pressure vessel and arranged substantially opposite to one another, each of said buoyancy tanks being generally arcuate.

19. A subsea vehicle as claimed in claim 1, wherein manipulators are supported on the vehicle structure, said manipulators being supported by way of buoyancy tanks which form support frames therefor.

20. A subsea vehicle as claimed in claim 1, wherein the vehicle structure carries two spaced video cameras which are mounted on a fixed and known baseline.

21. A subsea vehicle comprising a vehicle structure, and drive means supported by said vehicle structure for causing movement thereof, wherein said vehicle structure is configured to be substantially astable, and said drive means comprise a plurality of individual thrusters supported by the vehicle structure and arranged to provide movement thereof relative to six degrees of freedom, wherein four said thrusters are mounted circumferentially of the vehicle structure, said circumferentially mounted thrusters being equidistantly spaced around the circumference of the vehicle structure at a single longitudinal location of the structure.

22. A subsea vehicle as claimed in claim 21, wherein said astable vehicle structure is arranged to be able to roll through $\pm 180°$ and to pitch through $\pm 90°$.

23. A subsea vehicle as claimed in claim 22, wherein the vehicle structure has the ability to roll through 360 degrees.

24. A subsea vehicle as claimed in claim 21, wherein the vehicles structure includes a pressure vessel which is substantially cylindrical.

25. A subsea vehicle as claimed in claim 24, wherein electrical and electronic systems of the vehicle are mounted within the pressure vessel.

26. A subsea vehicle as claimed in claim 21, wherein the thrusters are all mounted in a fixed, predetermined alignment.

27. A subsea vehicle as claimed in claim 26, wherein at least six thrusters are supported on the vehicle structure.

28. A subsea vehicle as claimed in claim 27, wherein two thrusters are mounted on an end surface of the vehicle structure on a transverse axis of the vehicle structure.

29. A subsea vehicle as claimed in claim 28, wherein said two end thrusters are equidistantly spaced on either side of the central longitudinal axis of the vehicle structure at the aft end.

30. A subsea vehicle as claimed in claim 29, wherein each said end thruster is inclined at an angle to said transverse axis.

31. A subsea vehicle as claimed in claim 30, wherein said two end thrusters are each inclined at an angle of substantially 30 degrees to said transverse axis.

32. A subsea vehicle as claimed in claim 21, wherein each of the circumferentially mounted thrusters is located on a radius of the vehicle structure extending substantially at 45 degrees to the transverse axis thereof.

33. A subsea vehicle as claimed in claim 32, wherein alternative ones of said circumferentially mounted thrusters face in opposite directions.

34. A subsea vehicle as claimed in claim 21, wherein said four thrusters comprise a first group of thrusters located adjacent one end of the vehicle structure, and a second group of said plurality of individual thrusters, excluding the four thrusters of said first group thereof, mounted circumferentially about the vehicle structure adjacent an opposite end of the vehicle structure.

35. A subsea vehicle as claimed in claim 21, wherein a manipulator is supported on said vehicle structure.

36. A subsea vehicle as claimed in claim 21, wherein selected ones of said individual thrusters are supported at the aft end of the vehicle structure and wherein a plurality of manipulators are supported at the forward end of the vehicle structure.

37. A subsea vehicle as claimed in claim 21, wherein at least two manipulators are supported on said vehicle structure, said manipulators being moveable relative to one another.

38. A subsea vehicle as claimed in claim 21, wherein the vehicle structure includes a pressure vessel and further comprises buoyancy tanks supported by said pressure vessel and arranged to give the vehicle structure the required buoyancy and the required center of buoyancy.

39. A subsea vehicle as claimed in claim 21, wherein a pair of buoyancy tanks are arranged around the perimeter of the vehicle structure substantially opposite to one another.

40. A subsea vehicle as claimed in claim 21, wherein said vehicle structure includes a pressure vessel which is substantially cylindrical, and wherein a pair of buoyancy tanks are supported by said pressure vessel and arranged substantially opposite to one another, each of said buoyancy tanks being generally arcuate.

41. A subsea vehicle as claimed in claim 21, wherein manipulators are supported on the vehicle structure, said manipulators being supported by way of buoyancy tanks which form support frames therefor.

42. A subsea vehicle as claimed in claim 21, wherein the vehicle structure carries two spaced video cameras which are mounted on a fixed and know baseline.

43. A subsea vehicle comprising a vehicle structure, and drive means supported by said vehicle structure for providing propulsion thereto, wherein said vehicle structure is configured to be substantially astable, and said drive means comprise a plurality of individual thrusters supported by the vehicle structure and arranged to proved movement thereof relative to six degrees of freedom, wherein two thrusters are mounted on an end surface of the vehicle structure on a transverse axis of the vehicle structure, the two end thrusters being equidistantly spaced on either side of the central longitudinal axis of the vehicles structure at the aft end.

44. A subsea vehicle as claimed in claim 43, wherein each said end thruster is inclined at an angle to said transverse axis.

45. A subsea vehicle as claimed in claim 44, wherein said two end thrusters are each inclined at an angle of substantially 30 degrees to said transverse axis.

46. A subsea vehicle as claimed in claim 43, wherein at least six thrusters are supported on the vehicle structure, and wherein four of said thrusters are mounted circumferentially of the vehicle structure, said circumferentially mounted thrusters being equidistantly spaced around the circumference of the vehicle structure at a single longitudinal location of the vehicle structure.

47. A subsea vehicle as claimed in claim 46, wherein each of the circumferentially mounted thrusters is located on a radius of the vehicle structure extending substantially at 45 degrees to the transverse axis thereof.

48. A subsea vehicle as claimed in claim 47, wherein alternative ones of said circumferentially mounted thrusters face in opposite directions.

49. A subsea vehicle as claimed in claim 48, wherein two groups of four circumferentially arranged thrusters are provided, each group being located at opposite ends of the vehicle structure.

50. A subsea vehicle as claimed in claim 43, wherein a manipulator is supported on said vehicle structure.

51. A subsea vehicle as claimed in claim 43, wherein selected ones of said individual thrusters are supported at the aft end of the vehicle structure, and wherein a plurality of manipulators are supported at the forward end of the vehicle structure.

52. A subsea vehicle as claimed in claim 43, wherein at least two manipulators are supported on said vehicle structure, said manipulators being moveable relative to one another.

53. A subsea vehicle as claimed in claim 43, wherein the vehicle structure includes a pressure vessel and further comprises buoyancy tanks supported by said pressure vessel and arranged to give the vehicle structure the required buoyancy and the required center of buoyancy.

54. A subsea vehicle as claimed in claim 43, wherein a pair of buoyancy tanks are arranged around the perimeter of the vehicle structure substantially opposite to one another.

55. A subsea vehicle as claimed in claim 43, wherein said vehicle structure includes a pressure vessel which is substantially cylindrical, and wherein a pair of buoyancy tanks are supported by said pressure vessel and arranged substantially opposite to one another, each of said buoyancy tanks being generally arcuate.

56. A subsea vehicle as claimed in claim 43, wherein manipulators are supported on the vehicle structure, said manipulators being supported by way of buoyancy tanks which form support frames therefor.

57. A subsea vehicles as claimed in claim 43, wherein the vehicle structure carries two spaced video cameras which are mounted on a fixed and known baseline.

58. A method of working on an underwater work site using a remotely operated subsea vehicle, comprising the steps of orientating the vehicle near the work site in an upright attitude relative to the work site with forward end of the vehicle facing the work site and then performing tasks at the work site by way of equipment carried at the forward end of the vehicle, said vehicle being movable relative to six degrees of freedom so that it can be orientated in an upright attitude relative to the work site irrespective of the orientation of the work site and being provided with attachment means for attaching the vehicle in its upright attitude to a support surface, said attachment means being arranged to enable the vehicle to be translated and rolled relative to said support surface.

* * * * *